US010054396B2

(12) United States Patent
Hovsepian

(10) Patent No.: US 10,054,396 B2
(45) **Date of Patent: *Aug. 21, 2018**

(54) FLUSH SWITCH FOR HANDGUN ACCESSORY

(71) Applicant: Richard George Hovsepian, Alachua, FL (US)

(72) Inventor: Richard George Hovsepian, Alachua, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/082,816

(22) Filed: Mar. 28, 2016

(65) Prior Publication Data

US 2016/0209171 A1 Jul. 21, 2016

Related U.S. Application Data

(63) Continuation-in-part of application No. 14/336,263, filed on Jul. 21, 2014, now Pat. No. 9,328,994, and a continuation-in-part of application No. 14/082,322, filed on Nov. 18, 2013, now abandoned.

(51) Int. Cl.
*F41G 1/35* (2006.01)
*F41A 19/69* (2006.01)

(52) U.S. Cl.
CPC ..... *F41G 1/35* (2013.01); *F41A 19/69* (2013.01)

(58) Field of Classification Search
CPC ..... F41G 1/35
USPC ..... 42/117
See application file for complete search history.

(56) References Cited

U.S. PATENT DOCUMENTS 4,313,273 A * 2/1982 Matthews ..... F41G 11/001 42/117
4,777,754 A * 10/1988 Reynolds, Jr. ..... F41G 1/345 362/110
5,119,576 A * 6/1992 Erning ..... F41A 33/02 362/111
5,194,007 A * 3/1993 Marshall ..... F41A 33/02 42/114
5,485,695 A * 1/1996 Glock ..... F41G 1/35 362/113
5,495,675 A * 3/1996 Huang ..... F41G 1/35 124/87
5,557,872 A * 9/1996 Langner ..... F41C 23/22 362/114
5,590,486 A * 1/1997 Moore ..... F41G 1/35 362/110
5,654,594 A * 8/1997 Bjornsen, III ..... F41A 35/06 200/293.1
5,706,600 A * 1/1998 Toole ..... F41G 1/35 362/114
6,210,771 B1 * 4/2001 Post ..... D03D 15/00 139/1 R
6,276,088 B1 * 8/2001 Matthews ..... F21L 4/005 362/110
6,363,648 B1 * 4/2002 Kranich ..... F41G 1/35 42/114

(Continued)

*Primary Examiner* — Troy Chambers
*Assistant Examiner* — Bridget A Cochran
(74) *Attorney, Agent, or Firm* — Sven W. Hanson

(57) ABSTRACT

A handgun mounted accessory such as a laser sight is combined with a trigger-guard mounted flush profile switch to provide high reliability of operation. The switch is designed and located to provide passive user switching in use without separate movement or applied force of the user's hand or fingers.

7 Claims, 8 Drawing Sheets

(56) References Cited

U.S. PATENT DOCUMENTS 6,378,237 B1 * 4/2002 Matthews ..... H01H 3/20 42/124
7,264,369 B1 * 9/2007 Howe ..... F41G 1/35 200/50.32
7,368,921 B2 * 5/2008 Deangelis ..... G01D 5/2405 324/661
7,506,468 B2 * 3/2009 Farrell ..... F41A 17/06 42/70.01
7,845,817 B1 * 12/2010 Miller ..... F41G 1/35 362/110
8,121,283 B2 * 2/2012 Peng ..... G06F 3/044 345/173
8,256,154 B2 * 9/2012 Danielson ..... F41G 1/35 42/117
8,387,294 B2 * 3/2013 Bolden ..... F41H 13/00 42/1.01
8,683,731 B2 * 4/2014 Kowalczyk ..... G01B 11/27 42/111
8,692,799 B1 * 4/2014 Landry ..... G06F 3/044 345/173
2002/0148153 A1 * 10/2002 Thorpe ..... F41G 1/35 42/114
2005/0252065 A1 * 11/2005 Scherpf ..... F41G 1/34 42/123
2010/0064568 A1 * 3/2010 NuDyke ..... F41A 17/06 42/117
2011/0003269 A1 * 1/2011 Portoghese ..... F41A 33/02 434/18
2011/0107648 A1 * 5/2011 Tuz ..... F41C 9/02 42/117
2012/0144718 A1 * 6/2012 Danielson ..... F41G 1/35 42/117
2013/0185982 A1 * 7/2013 Hilbourne ..... F41G 1/35 42/117
2015/0113851 A1 * 4/2015 Bensayan ..... F41A 17/063 42/117
2015/0267998 A1 * 9/2015 Grace, Jr. ..... F41G 1/345 42/117
2016/0209171 A1 * 7/2016 Hovsepian ..... F41G 1/35

* cited by examiner

FLUSH SWITCH FOR HANDGUN ACCESSORY

RELATED APPLICATIONS

This application claims benefit of pending U.S. Nonprovisional application Ser. No. 14/336,263 filed Jul. 21, 2014 claiming benefit of U.S. Provisional application No. 61/892,700 filed by the same applicant on Oct. 18, 2013, and also claims benefit of pending U.S. patent application Ser. No. 14/082,322, all of which prior application disclosures are incorporated by reference herein.

BACKGROUND OF THE INVENTION

The present invention pertains to switching mechanisms used to operate and power associated laser sights and similar devices used mounted on handguns. There are many designs of handgun sights that project a laser-produced light beam as a guide for aiming. One of the important features of any laser sight is the manner in which it is switched or powered-on for use. A laser sight is typically unpowered prior to use, but there are many known reasons why it is desirable that the laser be easily and quickly switched on by the user prior to or during aiming. Particularly during events associated with self-defense, when a handgun must be used as a weapon, the ability to switch on a weapon's laser sight without significant mental or physical effort is acknowledged to be critical.

Various laser sight power switches have been developed in the past that attempt to address this need. Some prior art designs have used a switch placed on the handgun grip-operable by the user's middle finger. However, in operation of handguns, there is a phenomena in some users that is referred to as "limp wristing" in which a handgun user does not firmly grasp the handgun grip with the middle finger, but allows that finger to maintain a position curved forward of the grip, under the trigger guard. This event is a problem when the middle is intended and needed to operate a laser sight switch. In such a case, a laser switch located under the trigger guard and on the grip, such as is typified by the designs illustrated in U.S. Pat. No. 8,256,154 to Danielson et al., may not successfully function.

What is desired is a switch to enable powering a laser sight in a handgun that functions without conscience effort by the user and will be effective even when the user's middle finger is not firmly grasping the handgun grip.

Moreover there is a need to provide methods and devices for adaptable mounting laser sights and similar powered devices to a variety of gun frames that have different shapes and configurations.

SUMMARY OF THE INVENTION

The invention provides an adaptative mounted laser sight that may be combined with a trigger-guard mountable switch with flexible connections that accommodate various different geometries of handgun frames. The invention includes a laser sight having exterior surface contacts that mate to inventive contacts mounted on an underside surface of a conventional handgun frame. The contacts are located on the frame such that, when the laser sight is mounted on the frame, the mating contacts will form an electrical connection. The contacts are connected to a flush surface-mounted switch secured to the underside of the handgun trigger guard such as to provide passive user switching in use. The connecting electrical leads are flexible and configured to be surface-mounted on the handgun to allow for various geometries.

The invention includes a kit including a low-profile flush switch configured to be surface-mounted on a handgun trigger guard, one or multiple or adjustable, flexible traces to connect the switch to contacts located under the forward portion of the handgun barrel, and a laser light device configured to be mounted under the handgun barrel and electrically connecting to the contacts. The kit is configured to be applied to any of a great range of handgun geometries to provide a handgun-mounted switch controlled laser light sight. The kit may include multiple flexible carriers including the switch, traces and contacts, each carrier having a different geometry to accommodate different handguns.

The invention includes a method of improving existing and future handguns by securing a trigger guard mounted electric switch and a laser sight to provide passive user operation of a laser sight during use of the handgun. The invention also includes a method of mounting and controlling a laser sight on a handgun in which a flush switch is surface-mounted to a trigger guard and flexible electrical leads are surface-mounted to the trigger guard and gun frame forward of the trigger guard to connect to an electrical contact there. A laser sight with electrical contacts is then mounted to the gun frame to connect the laser sight contacts with those on the gun frame to enable the switch to control the laser sight operation.

In alternative configurations, the switch and electrical lead elements may be constructed flush mounted by disposition of a conductor within the surface of a non-conductive gun frame such as the outer surface of the associated trigger guard.

The advantages of the inventive system are also provided in laser light devices by integrating the switch or electrical traces onto or into a laser light supporting frame or body.

In other embodiments of the invention, the construction and benefits of the inventive electrical power control elements are used in conjunction with any of a variety of powered devices that are used mounted on a firearm.

Other novel aspects and benefits of the invention are made clear from the following description of detailed embodiments and the associated drawing figures. While the invention is discussed in regards to handguns, the same concepts are applicable to other firearms having the same structural features enabling the invention.

DESCRIPTION OF EMBODIMENTS OF THE INVENTION

Figure 1:
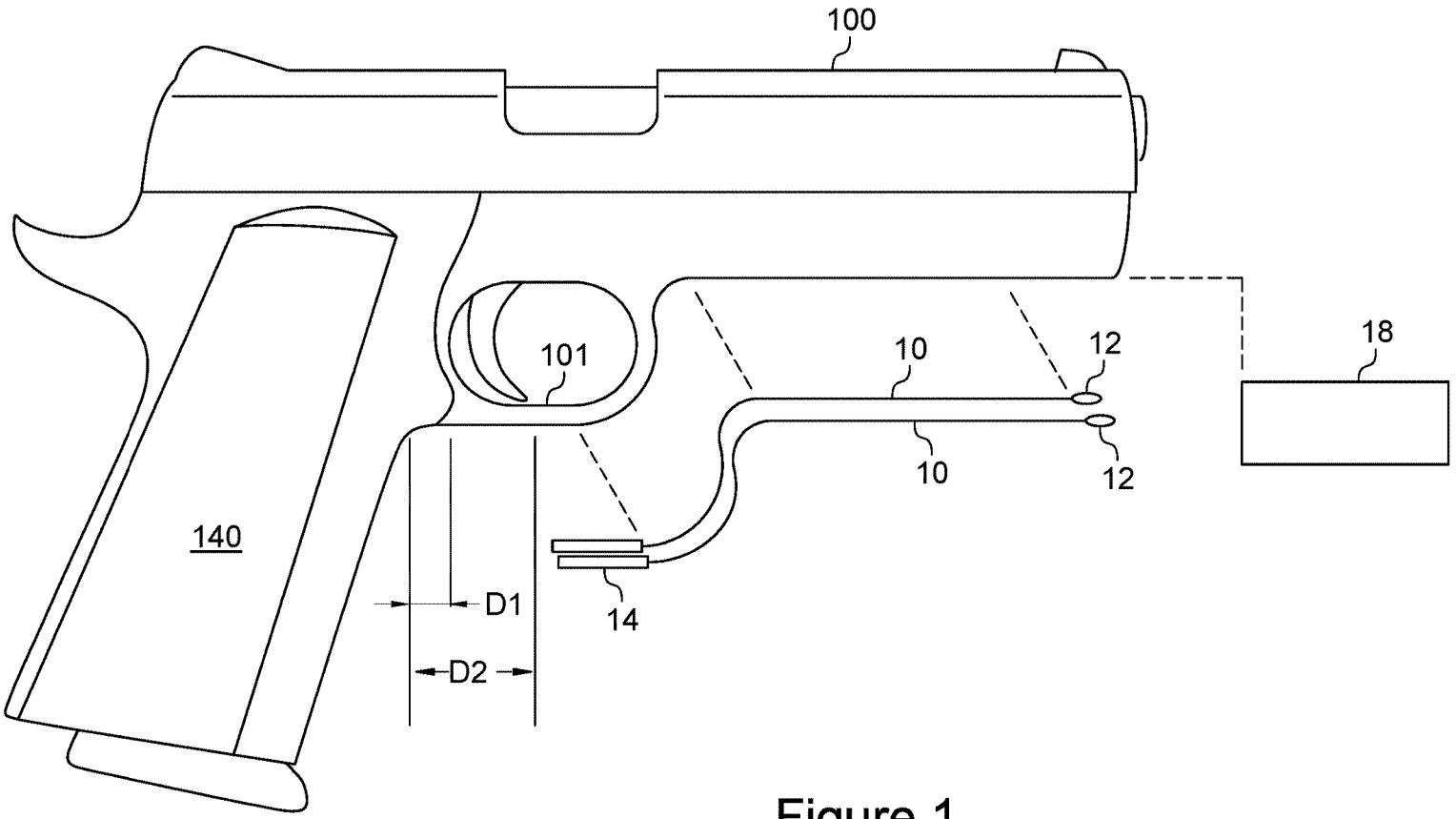
FIG. 1 is a side view of the inventive laser system.
Figure 2:
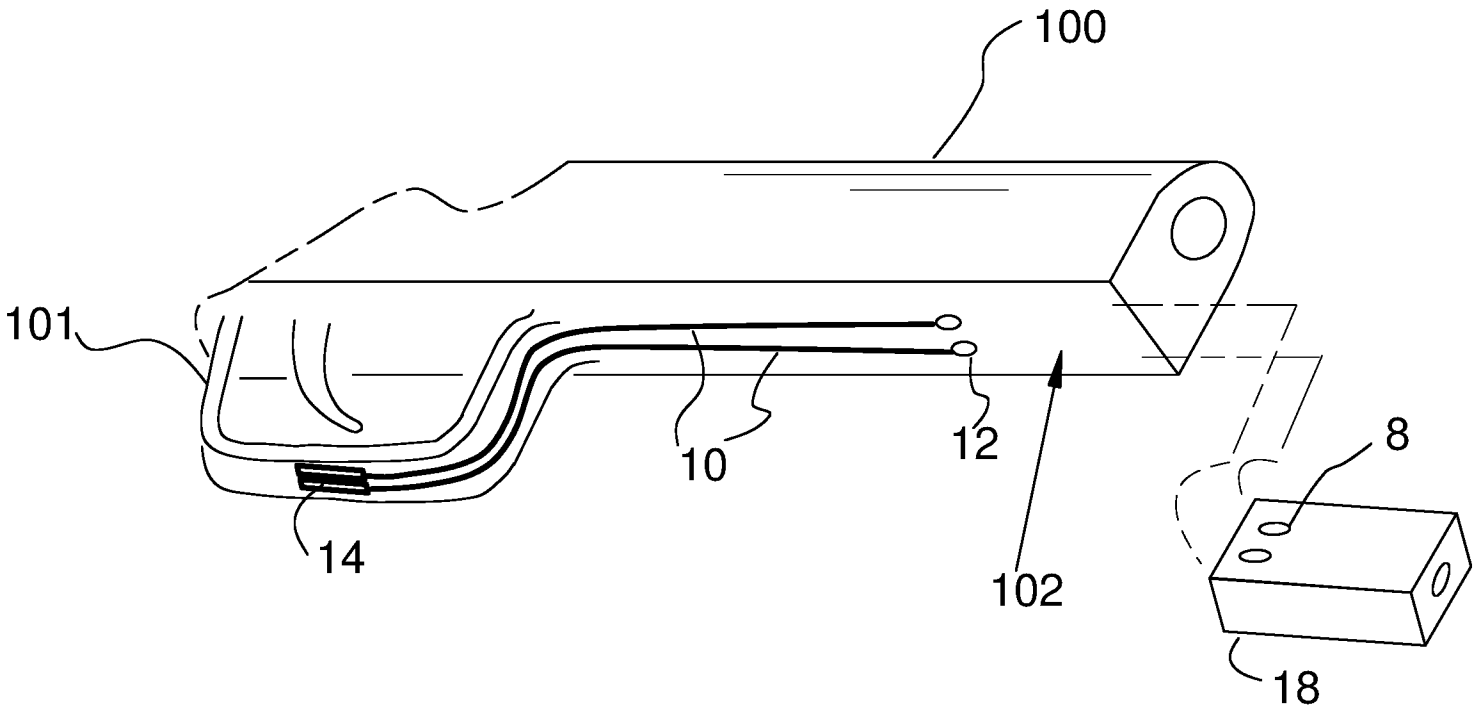
FIG. 2 is a perspective view of the underside of a portion of a conventional handgun incorporating the inventive laser system.

FIGS. 1 and 2 illustrate some of the fundamental components of the inventive laser sight system. In FIG. 1, a laser sight 18 and components of a switch 14 and connecting elements are illustrated separated from the associated handgun 100. The handgun is representative of any of various handguns that may have different shapes or forms. FIG. 2 illustrates the switch 14 and connecting elements mounted on the handgun 100. The laser sight 18 is configured to be removably mounted to a conventional handgun 100 through existing hardware features. The laser sight 18 in FIG. 2 is shown unmounted from the handgun 100 and rotated to better reveal the inventive aspects of the device. The manner and devices for mounted the laser sight 18 may include those conventionally found on handguns. Preferably, a picatinny rail system is provided with respective mating structures on the handgun 100 and the laser sight 18 to provide a securing structure. The details of the mating mounting elements are not illustrated.

The laser sight 18 also includes electrical sight contacts 8 located on an external surface of the laser sight 18. These sight contacts 8 are electrically connected to the laser sight power and control circuitry to allow the functions herein required. The laser sight circuitry will require modification from conventional designs to allow these functions, but otherwise, may follow conventional designs and function.

Mating contacts 12 are located on a downward facing undersurface 102 of the handgun. Their location and configuration are such that when the laser sight 18 is mounted as intended onto the handgun 100, the sight contacts 8 and mating contacts 12 are physically in contact to provide electrically connectivity between them. Preferably the undersurface 102 is horizontal (relative to normal operational attitude of the handgun), however a slightly angled surface may be accommodated by adjusting the angular orientation of the laser elements in the laser sight 18.

A switch 14 is located on the underside surface of the handgun trigger guard 101. The switch 14 is surface-mounted in form and function with a profile that is effectively flush with the surrounding surface of the trigger guard. This "flush" characteristic defines a construction and geometry where the switch 14 does not protrude substantially from the surface on which it is mounted (trigger guard downward facing surface). This characteristic further specifies a configuration that does not create a physical impediment to a user's finger's movement, forward and backward, over the surface. Details of the switch 14 are provided below.

A flush switch configuration may also be provided by conductive traces or leads formed directly on or within surface furrows or grooves formed in a nonconductive handgun frame. This is discussed in more detail in a further section herein.

The switch 14 is connected to the mating contacts 12 through electrically conducting flexible traces 10. The traces 10 are surface-mounted and flush and follow and are secured to the outside surface of the handgun 100 between the switch 14 and the mating contacts 12. Generally in the invention, when the laser sight 18 is mounted to the handgun 100 to connect the mating contacts 12 to the sight contacts 8, the power and operation of the laser sight 18 are thereby controlled by operation of the switch 14.

The contacts 8, 12, switch 14 and flexible traces 10 are constructed and configured to enable them to adapt to a variety and range of handgun geometries and surface contour and allow these components to be applied to existing handguns without prior knowledge of the handgun geometry or shape. This requires that the switch 14 and traces 10, at least, are physically flexible while maintaining electrically conductivity. Because the inventive system is intended for use by consumer users without access to any but the simplest tools, the construction of these components must be durable and securable with simple materials.

Preferably, the mating contacts 12, traces 10 and switch 14 are integrally formed as a conductive metallic matrix deposited on a polymer film ribbon. Both the mating contacts 12 and the traces 10 may be mounted using any of a variety of structural adhesives such as epoxy adhesive. For use on metal gun frames, the film ribbon is required to provide effective electrically insulating characteristics. A significant advantage to this novel construction is the ability to adjust overall length of the device, from contacts 12 to the distal end of the switch 14, by simply cutting off a portion of the distal end of the switch 14.

Alternatively, the switch 14 and mating contacts 12 may be each separately formed of solid metal foil and secured to the handgun 100, separately from the traces 10, but joined to establish the required electrical connectivity.

Preferably, the contacts 12 have a surface diameter dimension of about four (4) millimeters while the traces 10 may have a width dimension in the range of four (4) to seven (7) millimeters. When a film ribbon carrier is used, the trace 10 height (above the handgun surface) is about 0.17 millimeter and must be less than 0.5 millimeter (½ mm) to satisfy the flush geometry requirement and its function.

The length of the trace 10, from the contacts 12 to the switch 14 may be altered to accommodate different configurations and shapes of handguns. Inventive kits may be provided with any of a variety, or multiple of, or adjustable length, traces to allow the user to fit the components on a handgun frame that is not predetermined.

The switch 14 must be operable by the user on simple contact, with and without a contact force against the surface, of the user's finger on any portion of the exposed surface of the switch 14 extending over the effective length of the switch 14. The switch 14 may function through use of electrically separated contact poles that are bridged by contact by the users finger.

It is critical that the configuration of the switch 14 enable powering of the laser sight as a consequence of the natural and inevitable handling of the associated handgun by a user. No additional motion or force can be required to be carried out by the user, as such might render the system unlikely to be operated when most critically needed and when the user is most likely to fail to effect switching to power the sight. Particularly, the user must not be required to move any of the gripping fingers or a trigger finger upward nor exert an upward force.

For this function, the switch 14 must be configured to function whenever a human finger is located anywhere within an effective switching range SL forward of a point on the grip 140 at its junction with the bottom of the trigger guard 101. Experimentation by the inventor here has determined that the effective switching length SL is dependent on the size of a typical human user's finger and the furthest distance from the grip 140 that a user might place their finger if they did not fully grasp the grip with the middle finger. On this basis, it has been found that the switch 14 itself should have an effective length that extends, at a minimum, from a first location distance D1 of 0.25 inches (6 millimeters) forward from the grip to a second location distance D2 of 0.625 inches (16 millimeters) forward from the grip. This results, in one embodiment with a shortest physical switch length (D2–D1), with a switch length of 0.375 inches (9.6 millimeter). The switch 14 may extend closer to the grip 140 if the particular switch design requires it, but the D1 dimension defines a maximum gap from the grip that effective switching need not be provided. From that maximum gap to the D2 dimension point, switching control must be provided to provide the necessary passive operation. The switch 14 may also be operable at a distance further from the grip 140, but such is believed unnecessary.

The laser sight 18 may have the general construction and design of any of many prior laser sight devices that also has provided sight contacts 8 on or extending from an upper surface of the sight 18 such as to enable connection with the mating contacts 12.

Figure 3:
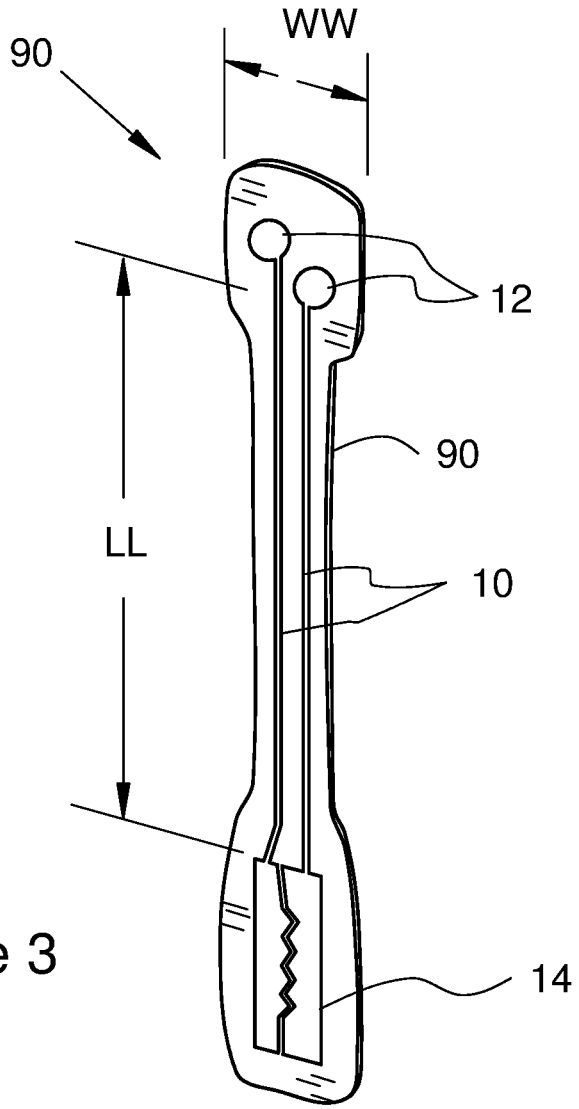
FIG. 3 is a perspective view of a flexible surface-mount carrier including a passive switch and laser sight power contacts according to the invention.

FIG. 3 is a perspective illustration of an integrated carrier 90 according to the invention. The carrier 90 includes a flexible substrate body 92 that is sufficiently thin to satisfy the flush mounting requirements herein. The substrate body 92 may be formed of any of a variety of nonconductive sheet materials or thin films and may include an adhesive backing. On one side face of the substrate body 92, the traces 10, contacts 12 and switch 14 are permanently formed or attached by any of various methods. Preferably, the contacts 12 are spatially separated from the switch 14 by a trace length dimension LL in the range of 3 to 5 inches. This length is effective to allow placement of the switch 14 at the desired location on the trigger guard on any of a great number of known handgun frames while allowing the carrier 90 to be surface-mounted to locate the contacts 12 at the appropriate location for connection with a laser sight when the sight is secured in the intended manner to the handgun frame.

To accommodate the surface bounds of the handguns of interest, the carrier has a maximum width dimension WW no greater than about 0.5 inch (12.2 millimeter). The overall length of the carrier should be no longer than a dimension within the range of 4 to 5 inches (100 to 127 millimeters). In commercial application, multiple carriers may be provided with different LL dimensions to accommodate different handgun geometries.

An inventive kit enabling fitting a laser sight to any of a number of different handguns includes a laser sight and one or more carriers; each carrier having a different LL dimension and configured to connect to the laser sight when secured to a handgun frame.

Figure 4:
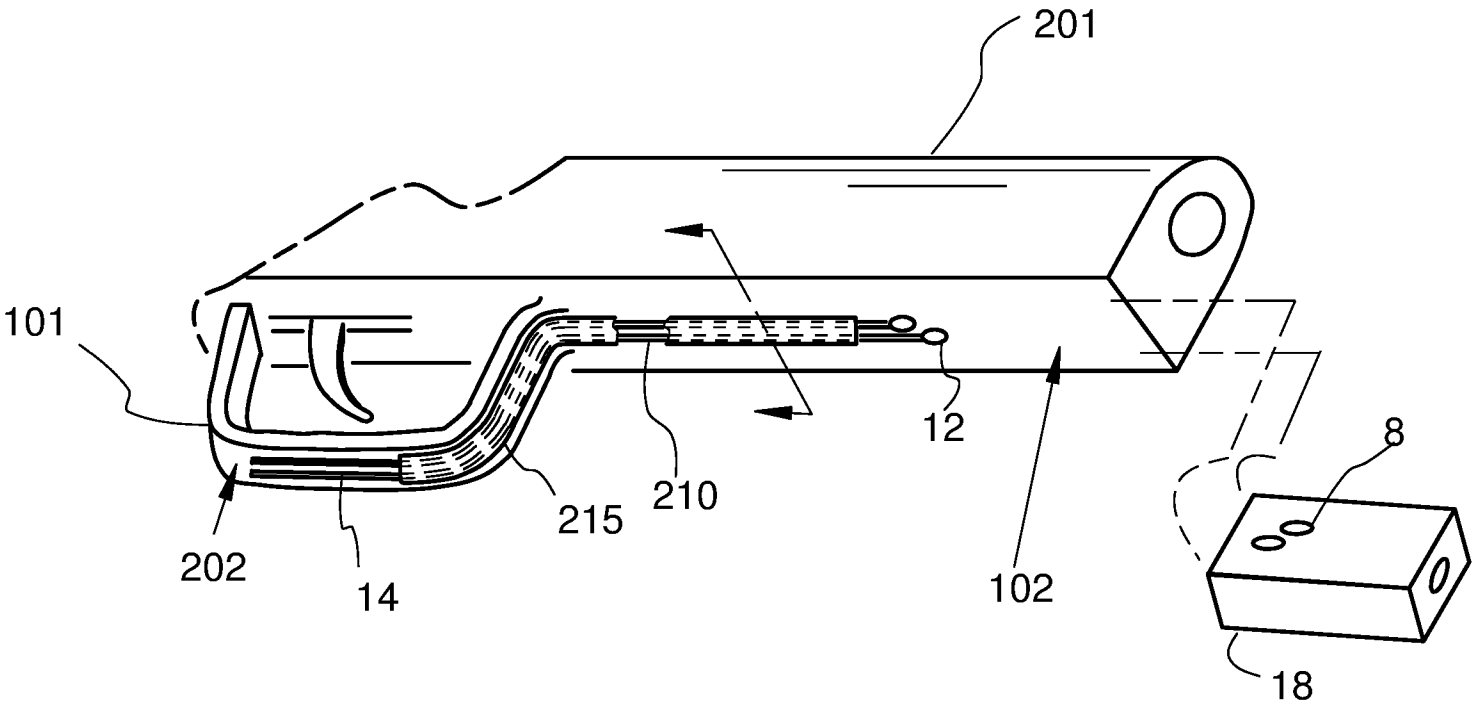
FIG. 4 is a perspective view of a handgun including an alternative electrical trace construction.

Many handgun frames are formed on nonmetalic materials including plastics, many of which are inherently nonconductive. As a result, such a handgun frame may be used to electrically isolate or separate electrical power or switching elements of a laser light device in the current invention. FIG. 4 depicts a non-conductive handgun frame 201 incorporating surface-formed electrical traces 210. FIGS. 5A, 5B, 5C and 5D are different detailed section views of alternative configurations the device in the FIG. 4 illustration. Each of the surface-formed traces 210 provide the same function as the carrier supported traces 10 discussed above and have the same flush characteristics. The surface-formed traces 210 may comprise metallic or other conductive material deposited on or formed in, in any of a variety of known techniques, the exposed surface 102 of the non-conductive handgun frame 201.

Figure 5A:
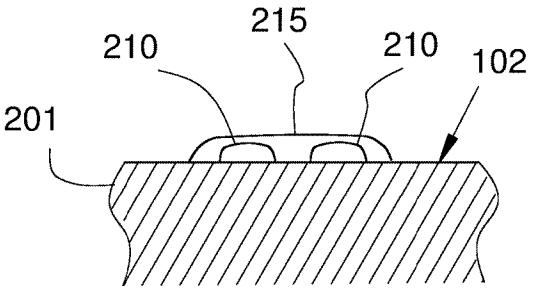
FIGS. 5A, 5B, 5C and 5D are various different configurations of the inventive conductive traces seen as section views of the traces in FIG. 4.
Figure 5B:
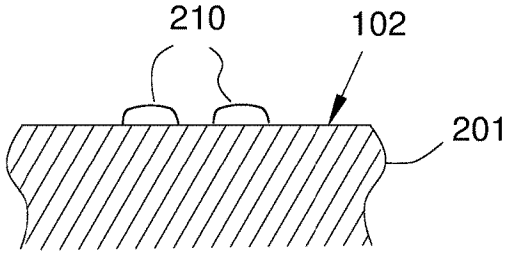
Figure 5C:
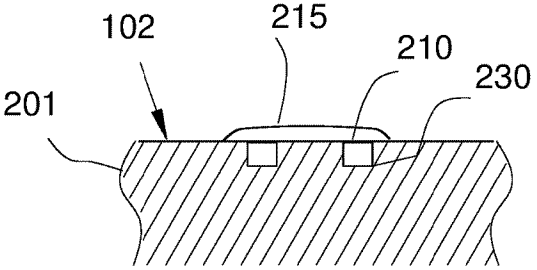
Figure 5D:
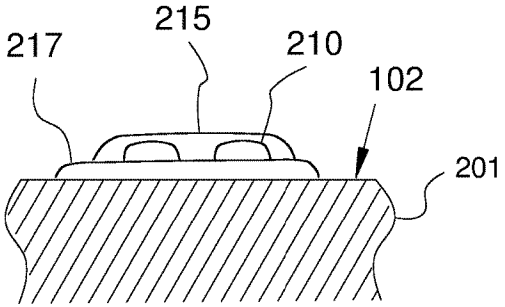

For deposition into the frame 201, as illustrated in FIG. 5C, the frame must be formed to include surface furrows or grooves 230 (or a like elongated cavity extending between the desired positions of electrical service). Such grooves 230 may be formed integral with the formation of the frame 201 or formed in a completed frame 201 through milling or other conventional material removal process.

The laser sight contacts 8 and mating frame contacts 12 may have the same configuration and coordinated function as described above. The frame contacts 12 are electrically connected to the traces 210 to enable the desired operation.

FIGS. 5A and 5B illustrate two configurations of traces 210 formed on the surface 102 of a non-conductive handgun frame 201. In FIGS. 5A and 5C, the traces 210 are electrically covered by an overlying nonconductive covering or sheath 215 (the sheath 215 is illustrated partially cut away in FIG. 4 to reveal the traces 210). This non-conductive sheath 215 may be formed by any convenient method and by any of a variety of non-conductive materials such as cold formed plastic or silicone or rubber. The construction of the sheath 215 should satisfy the primary function of preventing electrical conduction between the two traces 210 due to electrical "bridging" by contact with an incidental object, such as a user's hand or finger. The sheath 215 may extend over the length of the traces 210 necessary for this function.

In the configuration of 5D, a non-conductive base layer 217 is formed on the surface 102 and under the traces 210. This base layer 217 may be used with gun frames 201 formed of materials or components having conductive properties such that additional electrical isolation of the traces 210 is needed. For this purpose, the base layer 217 may extend under the entire extent of the traces 210, separating it physically and electrically from the gun frame 201. The base layer 217 and traces 210, and any sheath element 215, together, must be formed to maintain the necessary flush aspect discussed above. The base layer 217 may be formed from any of a variety of non-conductive materials such as those specified for the sheath 215 element above.

A switch 14, as described above, may be provided by an exposed section of traces 210 such is illustrated in FIG. 4, on the exposed downward facing outer surface of the handgun trigger guard 202. In this way, the switch 14 is an integral portion of the traces 210. The effective area for the switching function may be defined by the limits of the sheath 215 and the resulting exposed traces 210 that may be bridged by contact by a user's fingers as discussed above respecting other configurations of a switch.

Figure 6:
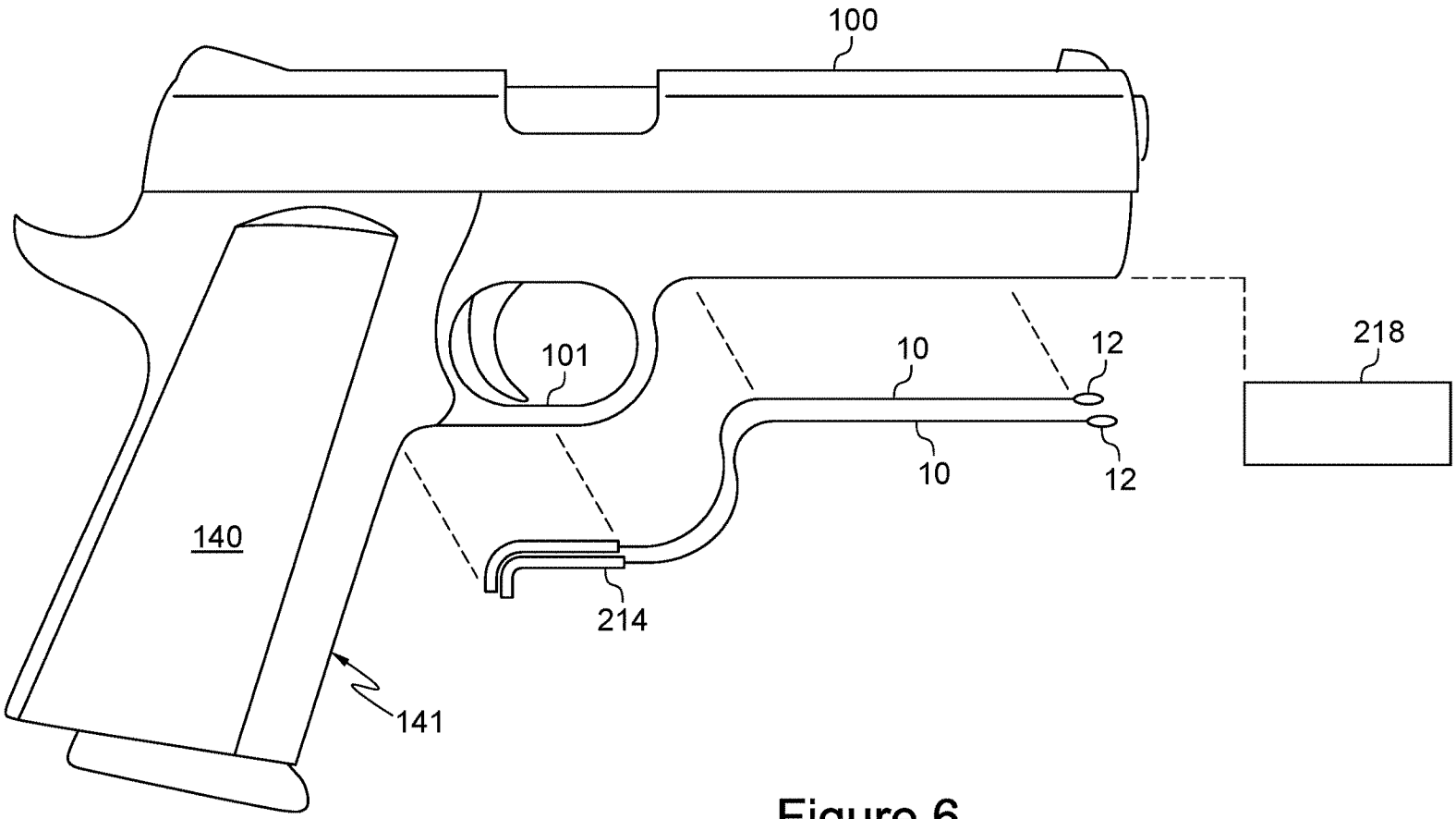
FIG. 6 is an alternative configuration of the inventive control system.

The advantages of the novel flush electrical traces and switch design and construction may be employed with alternative switch locations on a firearm frame. FIG. 6 illustrates a handgun 100 as described respecting FIG. 1. In this configuration, a switch 214 according to the invention is located under the triggerguard 101, but also extends rearward, curving through the intersection of the triggerguard 101 and handgun grip 140, to extend a short length downward on the forward facing surface 141 of the grip 140. The construction and design of the traces 10 and switch 214 follows the above discussion respecting the embodiment of FIG. 1. The portion of the switch 214 extends onto the grip 140 may provide, in some uses, an additional certainty in operation of the controlled system.

FIG. 6 includes a powered devices 218 that is mounted on the handgun 100 in the manner discussed above for a laser device. The powered device 218 may be, in alternative embodiments of the invention, other electrically powered devices benefitting from the novel control aspects of the invention. The devices may be, for example but not limited to, a GPS (Global Positioning System) device, an illuminating light, and other electrically controlled devices.

Figure 7A:
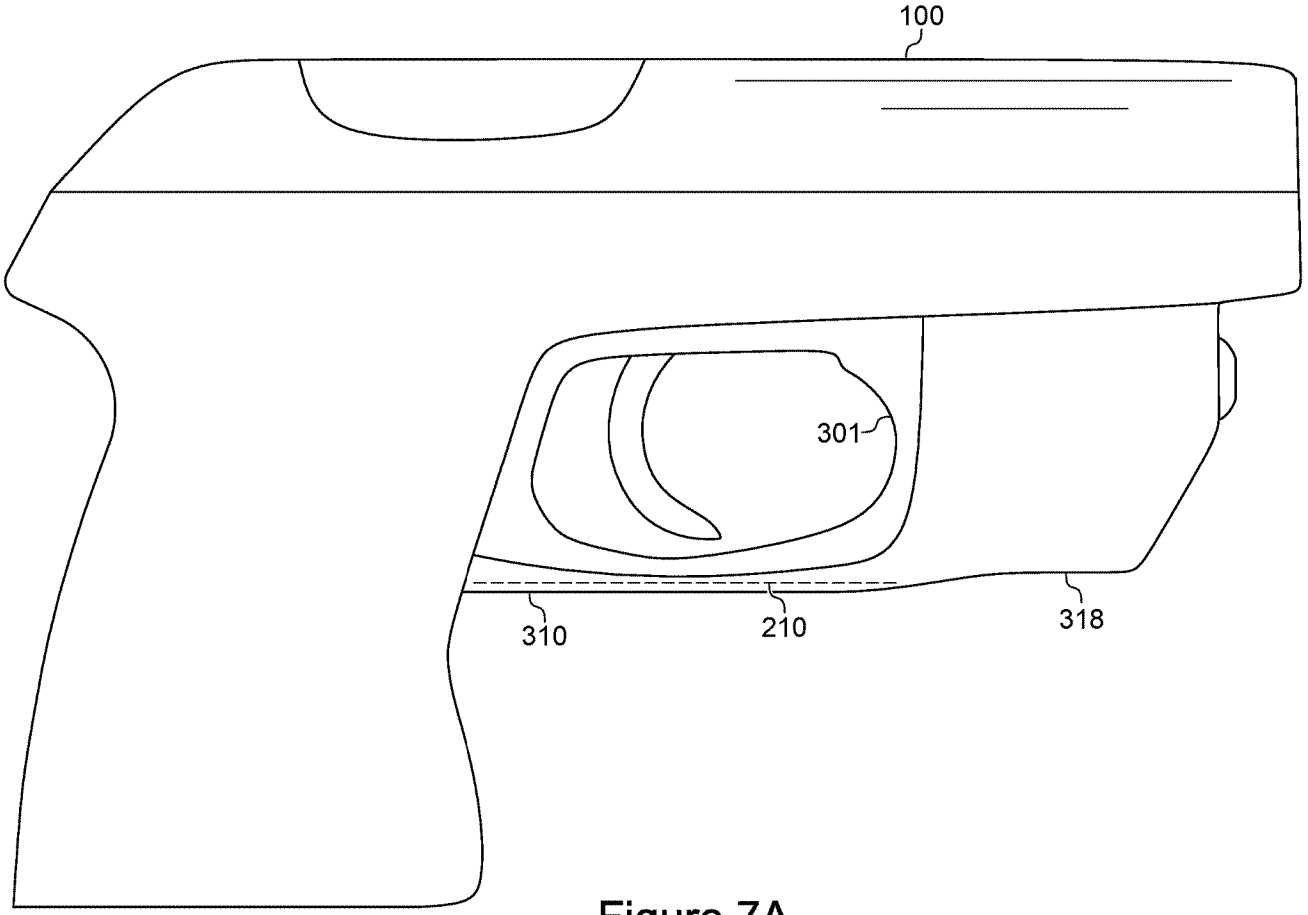
FIGS. 7A and 7B are side and perspective views of a handgun including an alternative attached laser sight device configuration including the inventive switch.
Figure 7B:
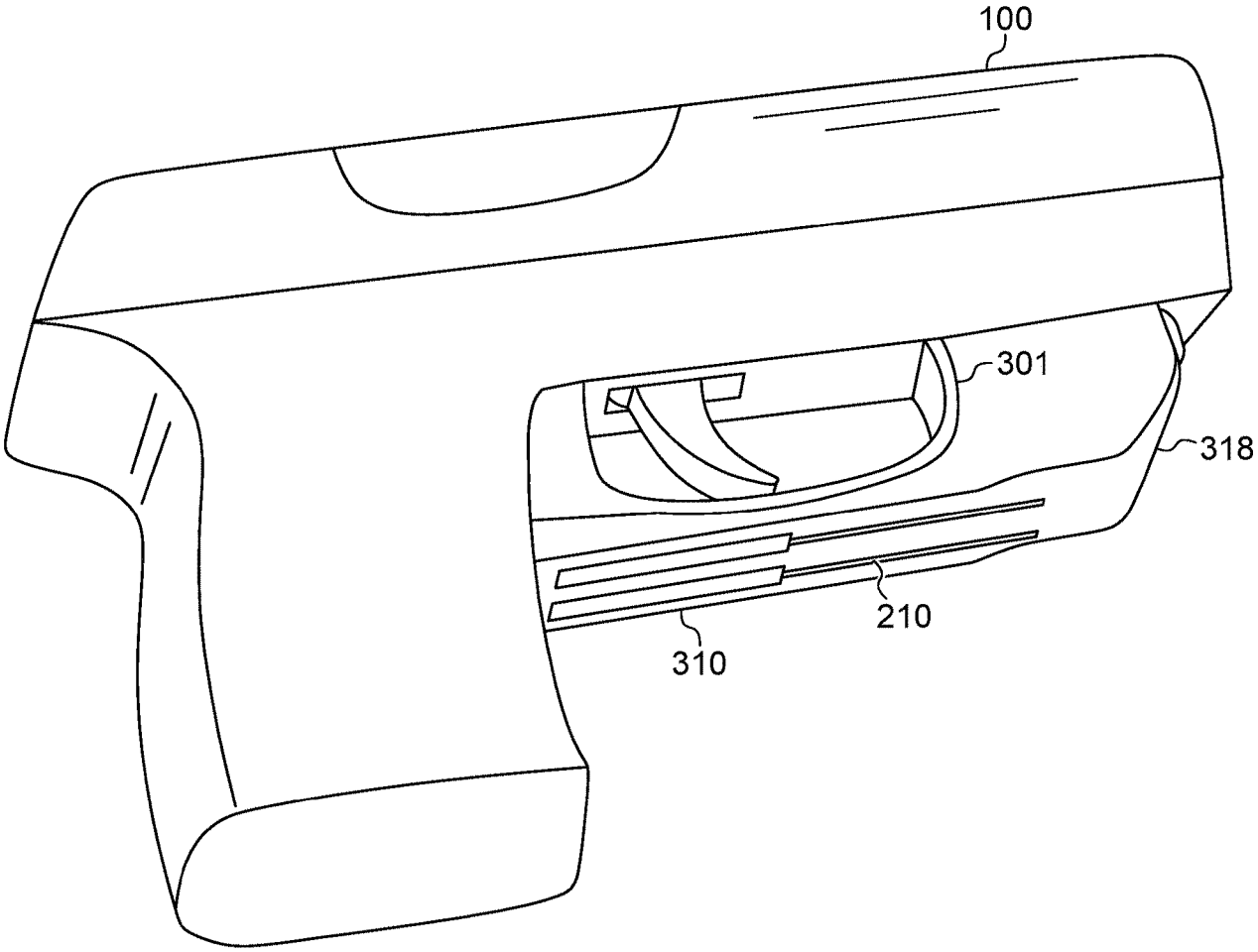

In alternative configurations, the laser light site control traces and switch may be formed on or in elements of a laser light site body that conform to the handgun frame so as to provide the same function as the frame elements. FIGS. 7A and 7B illustrate one example of a laser light device 318 that is secured to a handgun frame 201. The laser device 318 includes a rigid arm element 310 that extends over and around the handgun frame trigger guard 301. The arm element 310 may be used to carry and support control traces 210 that function constructed and with function as described respecting the configuration of FIG. 4. The various previously discussed forms of the inventive switch element may be incorporated in like manner in this configuration. For example, the power circuit connecting a laser power supply, such as a battery, may include flush surface traces on or in the body of the laser device 318 itself, and include a flush switch element. A portion of the control traces 210 may provide, and perform the function of, the switch element.

Alternative configurations and designs of the inventive switch, contacts and traces may be used in the same manner to carry out the invention. When used with a conductive metal frame handgun, a single contact may be used with a single trace while the gun frame itself is used as a part of a controlling circuit to operate the laser sight in similar manner. The invention includes systems used with any of a variety of firearms having the necessary cooperating features described herein. The term "handgun" is not intended to be limiting on the devices using the inventive concept, and any firearm having the particular features described herein and incorporating the novel features described should be considered within the invention.

The invention claimed is:

1. A firearm accessory control system, comprising:

a powered device removably secured to a firearm frame forward of a firearm triggerguard;

a conductive trace extending flushly on a downward facing outer surface of the triggerguard and extending to the powered device;

the conductive trace also forming a switch disposed on the downward facing outer surface, the switch being operable without displacement of any portion of the switch and with no force applied to the switch.

2. A firearm accessory control system, according to claim 1, and further comprises:

a nonconductive base layer disposed on the downward facing outer surface; and wherein:

the conductive trace is disposed on the base layer.

3. A firearm accessory control system, according to claim 1, and wherein:

the downward facing outer surface having elongated grooves; and the conductive trace is disposed within the elongated grooves.

4. A firearm accessory control system, according to claim 1, and wherein:

the powered device comprises a light.

5. A firearm accessory control system, according to claim 1, and wherein:

the switch extends onto the firearm grip.

6. A firearm accessory control system, according to claim 1, and wherein:

the conductive trace has a width and a height, the width greater than the height.

7. A firearm accessory control system, according to claim 6, and wherein:

the conductive trace width is in the range of four to seven millimeters, and the conductive trace height is less than 0.5 millimeters.

* * * * *